US005851076A

United States Patent [19]

No

[11] Patent Number: 5,851,076

[45] Date of Patent: Dec. 22, 1998

[54] PRINTER ADAPTED TO GUIDE A DYE DONOR THEREIN AND METHOD THEREFOR

[75] Inventor: Young No, Pittsford, N.Y.

[73] Assignee: Eastman Kodak Company, Rochester, N.Y.

[21] Appl. No.: 956,996

[22] Filed: Oct. 23, 1997

[51] Int. Cl.[6] ..... B41J 33/32

[52] U.S. Cl. ..... 400/248; 400/235

[58] Field of Search ..... 400/207, 208, 400/242, 246, 248, 250, 613, 613.1, 235, 235.1, 236, 247

[56] References Cited

U.S. PATENT DOCUMENTS 5,433,540 7/1995 Alday ..... 400/250

5,727,883 3/1998 Kusano et al. ..... 400/246

*Primary Examiner*—Ren Yan

*Attorney, Agent, or Firm*—Walter S. Stevens

[57] ABSTRACT

Printer adapted to guide a dye donor therein and method therefor. The dye donor ribbon has a leading end portion, which in turn has a plurality of sprocket holes spaced along parallel side portions of the leading end portion. A print head activates the dye donor ribbon to transfer dye therefrom onto a receiver for forming an image on the receiver. A dye donor ribbon take-up spool is disposed near the print head for taking-up the dye donor ribbon as the print head activates the dye donor ribbon. The take-up spool has a plurality of sprockets therearound sized to engage the sprocket holes in the leading end portion. A dye donor ribbon supply spool is spaced-apart from the take-up spool for supplying the dye donor ribbon therefrom as the print head activates the dye donor ribbon. A pair of spaced-apart oppositely disposed parallel guide rails extend between the take-up pool and the supply spool. Each of the rails defines a passage for guiding the dye donor ribbon along the passages. A support roller is disposed adjacently opposite the print head for supporting the receiver on the support roller in engagement with the dye donor ribbon as the print head activates the dye donor ribbon.

14 Claims, 4 Drawing Sheets

PRINTER ADAPTED TO GUIDE A DYE DONOR THEREIN AND METHOD THEREFOR

FIELD OF THE INVENTION

The present invention generally relates to printer apparatus and methods and more particularly relates to a printer adapted to guide a dye donor therein and method therefor.

BACKGROUND OF THE INVENTION

In a typical thermal resistive printer, a dye donor ribbon containing a repeating series of frames of different color heat transferable dyes (e.g., yellow, cyan and magenta colors) is spooled on a dye donor supply spool. The dye donor ribbon, which is typically formed from a thin and flexible dye carrying substrate, is fed from the supply spool and rewound onto a take-up spool. The donor ribbon moves through a nip defined between a thermal resistive print head and a dye-absorbing dye receiver. The dye receiver is in turn supported by a platen disposed adjacent the print head.

That is, at the beginning of a printing cycle, the print head is lifted away from the platen roller to allow the dye receiver to be transported to and placed upon the platen. The dye receiver transport system may be a set of capstan rollers. The print head engages the dye ribbon and presses the dye ribbon against the dye receiver to form a dye ribbon/dye receiver media sandwich. In this regard, the receiver may be cut sheets of coated paper or transparency and the print head may comprise, for example, a plurality of thermal resistive heating elements. When predetermined ones of the heating elements are energized, the heating elements are heated. In the presence of such heat and pressure, dye from the dye ribbon transfers to the dye receiver. Density of the dye printed on the receiver is a function of the heat energy delivered from the heating elements to the dye ribbon. Such printers offer the advantage of "continuous tone" dye density transfer by varying the heat energy applied to the heating elements, thereby yielding a plurality of variable dye density image pixels onto the receiver.

However, it is desirable to feed the donor ribbon from the supply spool to the take-up spool along a path precisely leading from the supply spool to the take-up spool so that the donor ribbon precisely aligns with the take-up spool. Precisely aligning the donor ribbon with the take-up spool allows the take-up spool to take-up the donor ribbon without "jamming" on the take-up spool. Such jamming is undesirable because when the donor ribbon jams on the take-up spool, operation of the printer must be stopped and the jammed donor ribbon cleared before printing can continue.

A video printer using a ribbon cassette accommodating an inked ribbon is disclosed in U.S. Pat. 5,584,587 titled "Ribbon Cassette And Video Printer For Use Therewith" issued Dec. 17, 1996 in the name of Takashi Koike, et al. According to this patent, the cassette has a take-up spool and a supply spool spaced apart from each other. A length of inked ribbon has opposite ends engaged with the supply spool and the take-up spool. However, this patent does not disclose a printer adapted to guide a dye donor therein and method therefor.

Therefor, there has been a long-felt need to provide a printer adapted to guide a dye donor therein and method therefor.

SUMMARY OF THE INVENTION

The invention resides in a printer adapted to guide a dye donor therein, the dye donor having a sprocket hole. The printer comprises a print head for activating the dye donor. A spool associated with the print head is provided for wrapping the dye donor therearound, which spool has a sprocket to engage the sprocket hole. A guide member associated with the spool is also provided for guiding the dye donor to the spool.

More specifically, the invention is a printer and method adapted to guide a dye donor ribbon therein, the dye donor ribbon having a leading end portion, which in turn has a plurality of sprocket holes spaced along parallel side portions of the leading end portion. A print head activates the dye donor ribbon to transfer dye therefrom onto a receiver for forming an image on the receiver. In addition a dye donor ribbon take-up spool is disposed near the print head for taking-up the dye donor ribbon as the print head activates the dye donor ribbon. The take-up spool has a plurality of sprockets therearound sized to engage the sprocket holes in the leading end portion. Moreover, a dye donor ribbon supply spool is spaced-apart from the take-up spool for supplying the dye donor ribbon therefrom as the print head activates the dye donor ribbon. Further, a pair of spaced-apart oppositely disposed parallel guide rails extend between the take-up pool and the supply spool. Each of the rails defines a passage for guiding the dye donor ribbon along the passages. A support roller is disposed adjacently opposite the print head for supporting the receiver on the support roller in engagement with the dye donor ribbon.

An object of the present invention is to provide to a printer and method adapted to guide a dye donor ribbon therein without "jamming".

A feature of the present invention is the provision of a pair of spaced-apart oppositely disposed parallel guide rails, each guide rail defining a passage for guiding the dye donor ribbon therealong.

An advantage of the present invention is that "jamming" of the dye donor ribbon in the printer is avoided as the dye donor ribbon feeds from a dye donor ribbon supply spool to a dye donor ribbon take-up spool.

These and other objects, features and advantages of the present invention will become apparent to those skilled in the art upon a reading of the following detailed description when taken in conjunction with the drawings wherein there is shown and described illustrative embodiments of the invention.

BRIEF DESCRIPTION OF THE DRAWINGS

While the specification concludes with claims particularly pointing-out and distinctly claiming the subject matter of the present invention, it is believed the invention will be better understood from the following description when taken in conjunction with the accompanying drawings wherein:

DETAILED DESCRIPTION OF THE INVENTION

The present description will be directed in particular to elements forming part of, or cooperating more directly with, apparatus in accordance with the present invention. It is to be understood that elements not specifically shown or described may take various forms well known to those skilled in the art.

Figure 1:
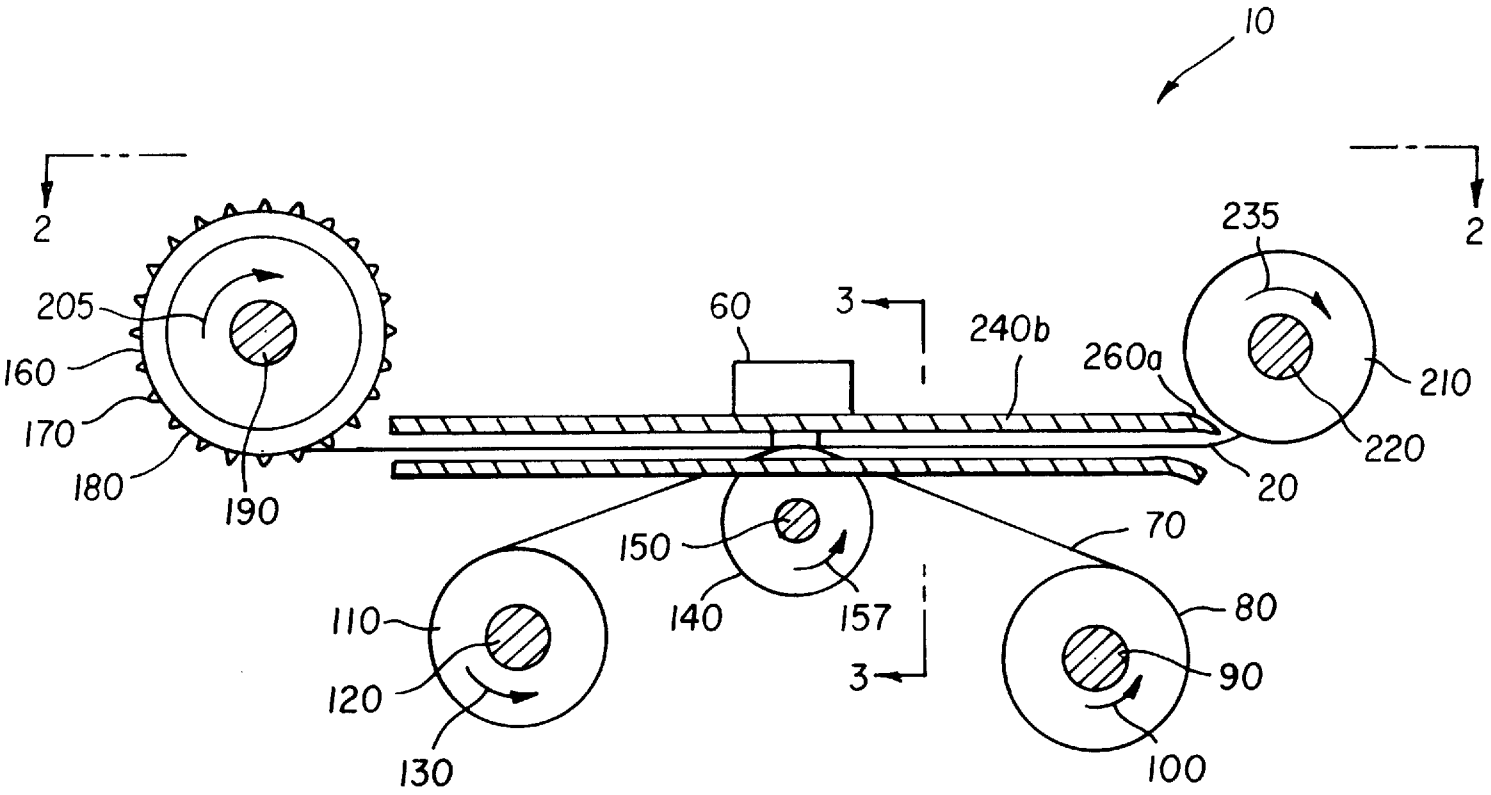
FIG. 1 is a view in elevation of a printer belonging to the present invention.
Figure 2:
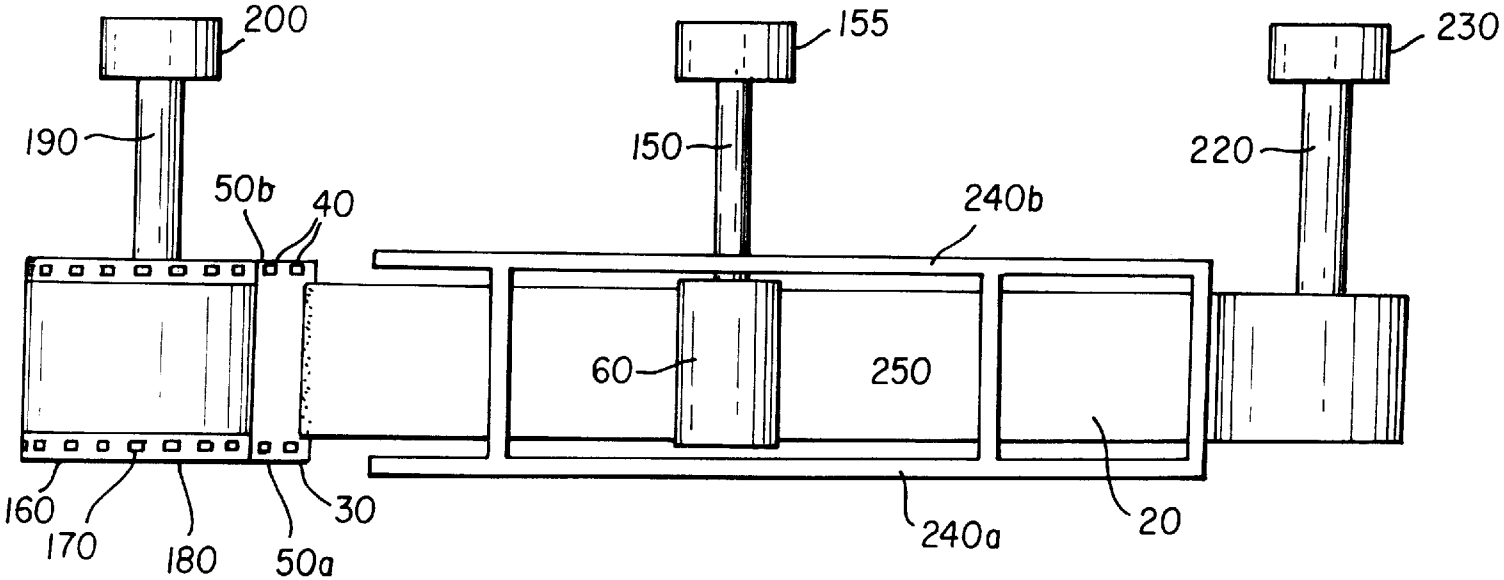
FIG. 2 is a view along section line 2—2 of FIG. 1.
Figure 3:
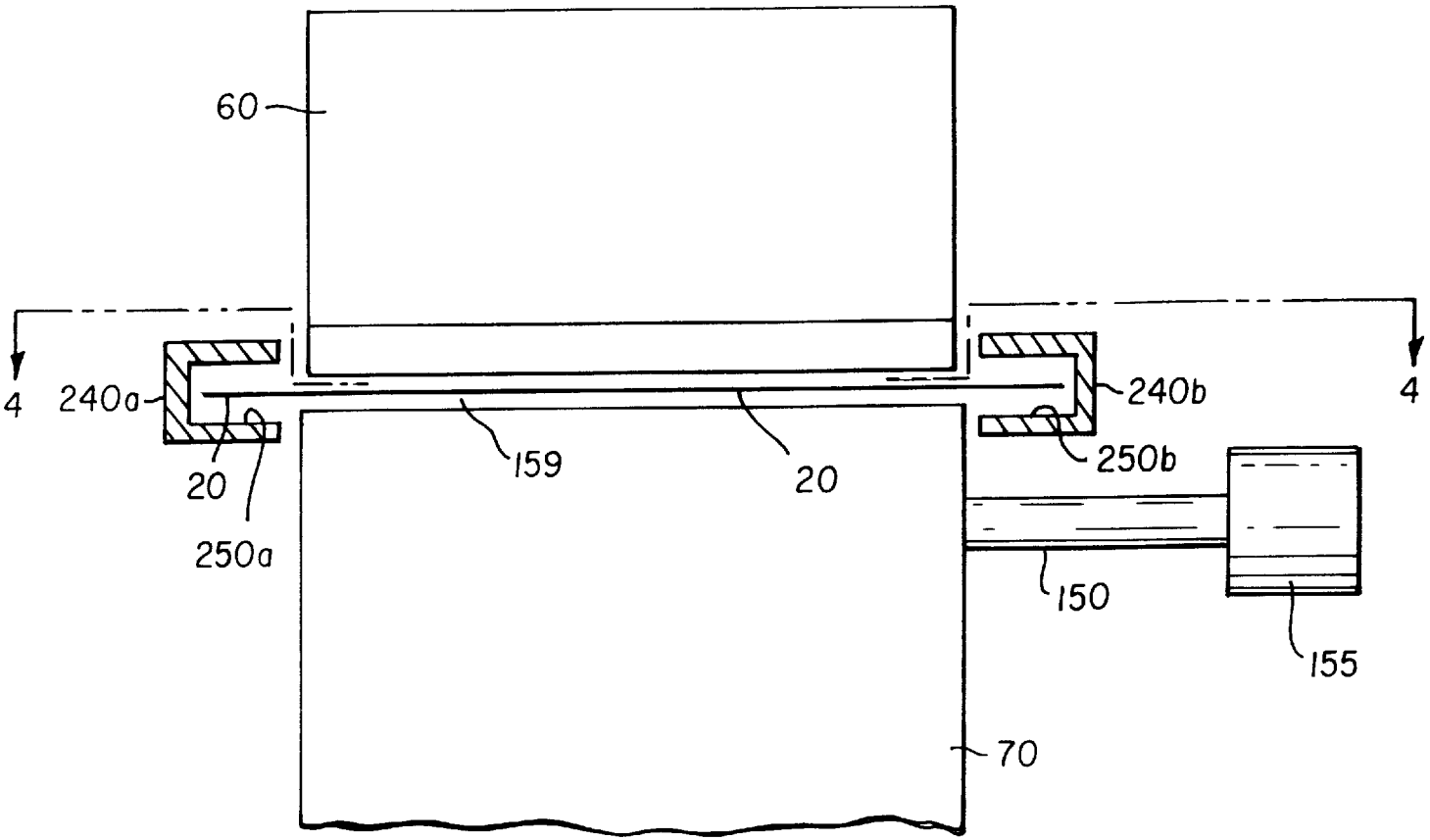
FIG. 3 is a view along section line 3—3 of FIG. 1.
Figure 4:
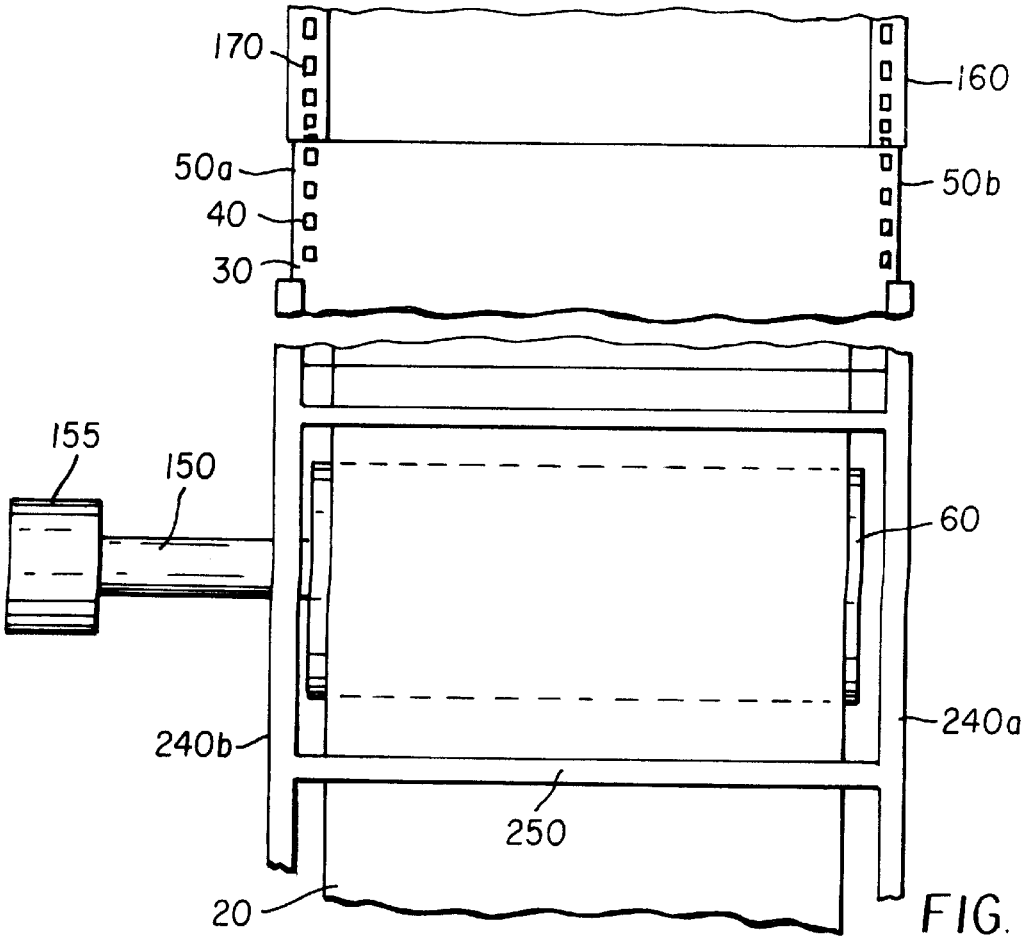
FIG. 4 is a view along section line 4—4 of FIG. 3.
Figure 5:
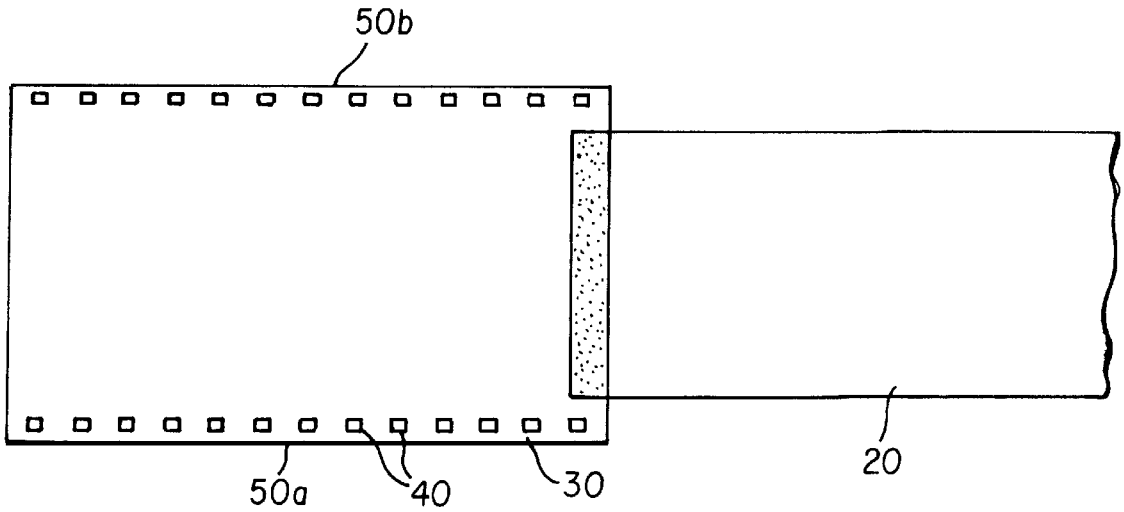
FIG. 5 is a view of a dye donor ribbon end portion having a leading end portion attached thereto.

Therefore, referring to FIGS. 1, 2, 3, 4 and 5, there is shown the subject matter of the present invention, which is a printer, generally referred to as 10, adapted to guide a dye donor ribbon 20 therein. For reasons provided in detail hereinbelow, ribbon 20 has a leading end portion 30 which has a plurality of sprocket holes 40 spaced along parallel side portions 50*a* and 50*b* belonging to leading end portion 30. A print head 60, which preferably is a thermal resistive print head, is provided for activating ribbon 20 to transfer dye therefrom onto a receiver 70 in order to form an image on receiver 70. In this regard, receiver 70 may be a roll of paper or transparency. Receiver 70 is fed from a receiver supply reel 80 mounted for rotation on a supply spindle 90 generally rotatable in a direction such as illustrated by an arrow 100. Spaced-apart from receiver supply reel 80 is a receiver take-up reel 110 for taking-up receiver 70 as receiver 70 is supplied from receiver supply reel 80. For this purpose, take-up reel 110 is mounted for rotation on a receiver take-up spindle 120 generally rotatable in a direction such as illustrated by an arrow 130. In this manner, receiver 70 extends from supply reel 80 to take-up reel 110. Interposed between supply reel 80 and take-up reel 110 is a support member, such as a roller 140, for supporting receiver 70 thereon as receiver 70 extends from supply reel 80 to take-up reel 110. Roller 140 may be motor driven by being mounted on a support spindle 150 engaging a first motor 155 capable of rotating spindle 150 in a direction such as illustrated by an arrow 157. Alternatively, roller 140 may be freely rotatable rather than being motor driven. Print head 60 and roller 140 define a clearance or nip 159 therebetween.

Referring again to FIGS. 1, 2, 3, 4 and 5, a dye donor ribbon take-up spool 160 is disposed near print head 60 for taking-up dye donor ribbon 20 as print head 60 activates dye donor ribbon 20. Take-up spool 160 has a plurality of sprockets 170 spaced around a circumference 180 thereof, which sprockets 170 are sized to engage sprocket holes 40 of leading end portion 30. Take-up spool 160 is mounted for rotation on a take-up shaft 190 engaging a second motor 200 capable of rotating shaft 190 in a direction such as illustrated by an arrow 205. Spaced-apart from take-up spool 160 is a dye donor ribbon supply spool 210 for supplying ribbon 20 therefrom as print head 60 activates ribbon 20. Supply spool 210 is mounted for rotation on a supply shaft 220 engaging a third motor 230 capable of rotating shaft 220 in a direction such as illustrated by an arrow 235. As receiver 70 is supported by roller 140 it is received in nip 159 adjacent to print head 60. Moreover, as ribbon 20 extends between supply spool 210 and take-up spool 160 it also is received in nip 159 adjacent to print head 60. As receiver 70 and ribbon 20 simultaneously reside in nip 159 print head 60 will engage ribbon 20 and press ribbon 20 against receiver 70 to form a dye ribbon/dye receiver sandwich thereat. Moreover, as print head 60 presses ribbon 20 against receiver 70, receiver 70 will engage ribbon 20 in order to form the dye ribbon/dye receiver sandwich. Thereafter, as print head 60 is lowered and activated, dye from ribbon 20 will transfer to receiver 70 to form an image on receiver 70. Moreover, motor driven roller 150 supports receiver 70 as receiver 70 engages ribbon 20. Thus, the dye ribbon/dye receiver sandwich formed by receiver 70 and ribbon 20 will simultaneously move past print head 60 as roller 150 is driven. In this manner, roller 150 assists ribbon 20 in moving past print head 60 due to force of friction acting between receiver 70 and ribbon 20.

Still referring to FIGS. 1, 2, 3, 4 and 5, a guide member, such as a rail assembly comprising a pair of spaced-apart oppositely disposed parallel guide rails 240*a* and 240*b* interconnected by at least one cross-tie 250 extends between supply spool 210 and take-up spool 160 for precisely guiding ribbon 20 between supply spool 210 and take-up spool 160. To accomplish this function, each guide rail 240*a* and 240*b* has a passage 250*a* and 250*b*, respectively, for precisely guiding ribbon 20 therealong. As previously mentioned, roller 150 assists ribbon 20 in moving past print head 60 due to force of friction acting between receiver 70 and ribbon 20. Therefore, roller 150 assists in translating ribbon 20 along passages 250*a*/*b* respectively defined by guide rails 240*a*/*b* . In addition, each guide rail 240*a*/*b* has a portion 260*a*/*b*, respectively, of predetermined shape (as shown) for intimately engaging leading end portion 30 of ribbon 20. The predetermined shape of portions 260*a*/*b* peels leading end portion 30 from supply spool 210 as supply spool 210 rotates by means of third motor 230. Moreover, portions 260*a*/*b* guides or directs leading end portion 30 into passages 250*a*/*b* after peeling leading end portion 30 from supply spool 210.

It is appreciated from the teachings herein that an advantage of the present invention is that take-up spool 160 takes-up dye donor ribbon 20 without "jamming" ribbon 20 on take-up spool 160. This is so because guide rails 240*a* and 240*b* precisely guide ribbon 20 from supply spool 210 to take-up spool 160 so that sprockets 170 will align with and thereafter matingly engage sprocket holes 170.

The invention has been described in detail with particular reference to certain preferred embodiments thereof, but it will be understood that variations and modifications can be effected within the spirit and scope of the invention. For example, a separate motor driven roller may be provided in addition to roller 140 for rotatably engaging ribbon 20 in order to translate ribbon 20 along passages 250*a*/*b* when roller 140 is freely rotatably rather than being rotated by first motor 155.

Moreover, as is evident from the foregoing description, certain other aspects of the invention are not limited to the particular details of the examples illustrated, and it is therefore contemplated that other modifications and applications will occur to those skilled in the art. It is accordingly intended that the claims shall cover all such modifications and applications as do not depart from the true spirit and scope of the invention.

Therefore, what is provided is a printer adapted to guide a dye donor therein and method therefor.

PARTS LIST

10 . . . printer
20 . . . dye donor ribbon
30 . . . leading end portion
40 . . . sprocket holes
50*a*/*b* . . . side portions
60 . . . print head
70 . . . receiver
80 . . . receiver supply reel
90 . . . receiver supply spindle
100 . . . arrow
110 . . . receiver take-up reel
120 . . . receiver take-up spindle
130 . . . arrow
140 . . . roller
150 . . . roller spindle
155 . . . first motor

157 . . . arrow
159 . . . nip
160 . . . dye donor take-up spool
170 . . . sprockets
180 . . . circumference
190 . . . take-up motor shaft
200 . . . second motor
205 . . . arrow
210 . . . dye donor ribbon supply spool
220 . . . supply motor shaft
230 . . . third motor
235 . . . arrow
240*a/b* . . . guide rails
250*a/b* . . . passages
260*a/b* . . . portions of guide rails

What is claimed is:

1. A printer adapted to guide a dye donor therein, the dye donor having a sprocket hole, comprising:

(a) a print head for activating the dye donor;

(b) a spool associated with said print head for wrapping the dye donor therearound, said spool having a sprocket to engage the sprocket hole; and (c) a guide member associated with said spool for guiding the dye donor to said spool, said guide member including a pair of spaced-apart parallel rails, each of said rails defining a passage therein for guiding the dye donor therealong.

2. A printer adapted to guide a dye donor ribbon therein, the dye donor ribbon having a sprocket hole, comprising:

(a) a print head for activating the dye donor ribbon;

(b) a first spool disposed near said print head for taking-up the dye donor ribbon thereon as said print head activates the dye donor ribbon, said first spool having a sprocket sized to engage the sprocket hole;

(c) a second spool spaced-apart from said first spool for supplying the dye donor ribbon therefrom as said print head activates the dye donor ribbon; and (d) a guide member interposed between said first spool and said second spool for guiding the dye donor ribbon therebetween, said guide member including a pair of spaced-apart parallel rails, each of said rails defining a passage therein for guiding the dye donor therealong.

3. The printer of claim 2, further comprising a support member disposed near said print head for supporting a receiver thereon in contact with the dye donor ribbon, so that an image forms on the receiver as said print head activates the dye donor ribbon.

4. The printer of claim 3, wherein said support member is adapted to assist movement of the dye donor ribbon along said guide member as said support member supports the receiver in contact with the dye donor ribbon.

5. A printer adapted to guide a dye donor ribbon therein, the dye donor ribbon having a leading end portion having a plurality of sprocket holes spaced along parallel side portions thereof, the printer comprising:

(a) a print head for activating the dye donor ribbon to transfer dye therefrom onto a receiver for forming an image on the receiver;

(b) a dye donor ribbon take-up spool disposed near said print head for taking-up the dye donor ribbon thereonto as said print head activates the dye donor ribbon, said take-up spool having a plurality of sprockets therearound sized to engage the sprocket holes;

(c) a dye donor ribbon supply spool spaced-apart from said take-up spool for supplying the dye donor ribbon therefrom as said print head activates the dye donor ribbon;

(d) a pair of spaced-apart oppositely disposed parallel guide rails extending between said take-up pool and said supply spool, each of said rails defining a passage therein for guiding the dye donor ribbon therealong; and (e) a support member disposed adjacently opposite said print head for supporting the receiver thereon in engagement with the dye donor ribbon, so that the image forms on the receiver as said print head activates the dye donor ribbon.

6. The printer of claim 5, wherein said support member is a motor-driven roller, so that said roller supports the receiver thereon in engagement with the dye donor ribbon, so that the receiver and the dye donor ribbon simultaneously move past said print head as said roller is driven and so that the dye donor ribbon translates along the passage defined by each guide rail as the receiver and dye donor ribbon simultaneously move past said print head.

7. The printer of claim 5, wherein each of said guide rails has a portion thereof of predetermined shape for intimately engaging the leading end portion of the dye donor ribbon for peeling the leading end portion from said supply spool and for thereafter directing the leading end portion into the passage defined by each guide rail.

8. A method of guiding a dye donor in a printer, the dye donor having a sprocket hole, comprising the steps of:

(a) activating the dye donor by operating a print head;

(b) wrapping the dye donor around a spool associated with the print head, the spool having a sprocket to engage the sprocket hole; and (c) guiding the dye donor to the spool along a guide member associated with the spool, wherein the step of guiding the dye donor ribbon along a rail assembly comprises the step of guiding the dye donor ribbon along a pair of spaced-apart parallel rails, each of the rails defining a passage therein for guiding the dye donor ribbon therealong.

9. A method of guiding a dye donor in a printer, the dye donor ribbon having a sprocket hole, comprising the steps of:

(a) activating the dye donor by operating a print head;

(b) taking-up the dye donor ribbon onto a first spool disposed near the print head as the print head activates the dye donor ribbon, the first spool having a sprocket sized to engage the sprocket hole;

(c) supplying the dye donor ribbon from a second spool spaced-apart from the first spool as the print head activates the dye donor ribbon; and (d) guiding the dye donor ribbon along a guide member interposed between the first spool and the second spool, wherein the step of guiding the dye donor ribbon along a guide member comprises the step of guiding the dye donor ribbon along a pair of spaced-apart parallel rails, each of the rails defining a passage therein for guiding the dye donor ribbon therealong.

10. The method of claim 9, further comprising the step of supporting a receiver on a support member disposed near the print head as the receiver contacts the dye donor ribbon, so that an image forms on the receiver as the print head activates the dye donor ribbon.

11. The method of claim 10, wherein the step of supporting the receiver comprises the step of assisting movement of the dye donor ribbon along the guide member as the support member supports the receiver in contact with the dye donor ribbon.

12. A method of guiding a dye donor in a printer, the dye donor ribbon having a leading end portion having a plurality of sprocket holes spaced along parallel side portions thereof, the method comprising the steps of:

(a) activating the dye donor ribbon by operating a print head to transfer dye therefrom onto a receiver for forming an image on the receiver;

(b) taking-up the dye donor ribbon onto a dye donor ribbon take-up spool disposed near the print head as the print head activates the dye donor ribbon, the take-up spool having a plurality of sprockets therearound sized to engage the sprocket holes;

(c) supplying the dye donor ribbon from a dye donor ribbon supply spool spaced-apart from the take-up spool as the print head activates the dye donor ribbon;

(d) passing the dye donor ribbon along a passage defined in each of a pair of spaced-apart oppositely disposed parallel guide rails extending between the take-up pool and the supply spool; and (e) supporting the receiver on a support member disposed adjacently opposite the print head as the receiver contacts the dye donor ribbon, so that an image forms on the receiver as the print head activates the dye donor ribbon.

13. The method of claim 18, wherein the step of supporting the receiver comprises the step of supporting the receiver on a motor-driven roller, so that the roller supports the receiver thereon in engagement with the dye donor ribbon, so that the receiver and the dye donor ribbon simultaneously move past the print head as the roller is driven and so that the dye donor ribbon translates along the passage defined by each guide rail as the receiver and dye donor ribbon simultaneously move past the print head.

14. The method of claim 12, wherein the step of passing the dye donor ribbon along a passage defined in each of a pair of spaced-apart oppositely disposed parallel guide rails comprises the step passing the dye donor ribbon along a passage defined in each of a pair of spaced-apart oppositely disposed parallel guide rails each having a portion thereof of predetermined shape for intimately engaging the leading end portion of the dye donor ribbon for peeling the leading end portion form the supply spool and for thereafter directing the leading end portion into the passage defined by each guide rail.

* * * * *